United States Patent [19]

Baker et al.

[11] Patent Number: 4,734,817

[45] **Date of Patent: * Mar. 29, 1988**

[54] MAGNETIC CLUTCH

[75] Inventors: William A. Baker, Milwaukee; Richard Shemanske, Brookfield, both of Wis.

[73] Assignee: PT Components, Inc., Indianapolis, Ind.

[ * ] Notice: The portion of the term of this patent subsequent to Sep. 2, 2003 has been disclaimed.

[21] Appl. No.: 901,266

[22] Filed: Aug. 28, 1986

Related U.S. Application Data

[63] Continuation-in-part of Ser. No. 669,683, Nov. 9, 1984, Pat. No. 4,609,965.

[51] Int. Cl.[4] ..... H01H 47/32

[52] U.S. Cl. ..... 361/190; 361/154; 192/84 B

[58] Field of Search ..... 361/154, 160, 190, 194, 361/210; 335/256, 266; 192/84 A, 84 B, 84 E, 77, 78; 310/92, 94; 370/140, 575, 577, 584

[56] References Cited

U.S. PATENT DOCUMENTS

| | | | |
|---|---|---|---|
| 1,872,369 | 8/1932 | Van Sickle | 335/256 |
| 2,457,017 | 12/1948 | Walley | 335/266 |
| 2,540,022 | 1/1951 | Rabenda | 335/266 |
| 2,951,189 | 8/1960 | Hajny | 335/266 |
| 3,763,968 | 10/1973 | Noly | 361/210 |
| 4,609,965 | 9/1986 | Baker . | |

*Primary Examiner*—L. T. Hix
*Assistant Examiner*—David M. Gray
*Attorney, Agent, or Firm*—Robert A. Brown

[57] ABSTRACT

A device is provided that begins an electrical starting mode in a parallel circuit configuration providing an improved speed of response and after an interval of time, current is switched to a series circuit configuration for operation during a run mode. The device is initially energized at several times the power normally required to activate a coil and switching means is thereafter utilized to reduce power to a normal requirement soon after the coil is energized. Specific hardware is provided in the form of schematic diagrams for defining the operation of the invention.

17 Claims, 10 Drawing Figures

MAGNETIC CLUTCH

This application is a continuation-in-part of application Ser. No. 669,683, filed Nov. 9, 1984 U.S. Pat. No. 4,609,965.

BACKGROUND OF THE INVENTION

The present invention relates generally to electromagnetic control devices, such as relays, solenoids, clutches and brakes and more particularly to a class of these devices wherein it is desired to "FORCE" the operation of the device so as to obtain rapid travel and overcome high inertial and spring loading.

It is common practice in the industry to provide the desired forcing action by generating a magnetic force that is substantially greater than required to marginally actuate the device or to maintain the device in an actuated state. This practice is acceptable in applications that require only a short or intermittent duty cycle where heat generated by such over-energizing is not deleterious to the life or operation of the device. When continuous duty is required, various switching arrangements have been used to connect an additional resistance or coil winding in such a way that additional force is obtained only when the device is initially energized and the magnetic force is thereafter reduced to a level sufficient to maintain the device energized but is within the continuous duty ratings of the device.

All of the prior art relating to this problem have a similar deficiency in that the additional coil or winding is only used for a portion of the operation. Some coils or windings are used only during pull-in and others are used only after pull-in has occurred. This obvious inefficiency is costly in terms of money, complexity, energy, size and weight.

Illustrative of the manner in which a number of inventors have attempted to solve existing problems may be found in U.S. Pat. Nos. 2,457,017; 2,540,022; and 2,951,189. In U.S. Pat. No. 2,457,017 to Walley, there is disclosed mechanical structure that emphasizes the advantages of high contact pressure, sensitivity and shock resistance due to the lightweight of the contacts. Electrically, it places a second winding in series with the main winding to reduce the current and power.

U.S. Pat. No. 2,540,002 to Rabenda discloses and teaches the use of two coils in PICK-UP & HOLD. Rabenda addresses the problem where many of these relays are used in close proximity; i.e., adding machines, etc. Each coil then acts as a miniature transformer and couples to the adjacent coils to alter their pick-up and release characteristics.

U.S. Pat. No. 2,951,189 to Hajny shows and teaches motor principles to cause rotation of a crank and thus operation of a valve. The rotary motion is also used to cause a switching action through a slip ring and contact arrangement to connect or disconnect a second coil in series with the pick-up. There are shown two switching arrangements. One shorts a coil out of the circuit and the other switches a coil into the circuit.

SUMMARY OF THE INVENTION

Accordingly, it is a primary object of the present invention to provide an improved electromagnetic device and associated switching means which will supply an optimum magnetic force or ampere turns during a start mode or pull-in condition and a minimum magnetic force of ampere turns after pull-in and during a run mode and thereby overcome the aforementioned disadvantages of the prior art.

It is a further object of the present invention to provide a device that includes the desired features of increased ampere turns during pull-in and decreased ampere turns after pull-in at a maximum speed of response or during a reduced or minimum interval of time. The instant invention can be accomplished by using tools, techniques and materials presently available to the ordinary person skilled in the art.

An additional object of the present invention is to provide an improved arrangement for obtaining a desired forcing function at a maximum speed of response that can be adapted to equipment and devices presently installed or operating in the field and thereby greatly improve their performance.

A device in accordance with the present invention comprises a unique switching arrangement, actuated by appropriate switching means, which places two or more windings of an electromagnetic coil first in a parallel configuration for pull-in and then in a series configuration after pull-in. The advantages achieved by the present invention include maximum flux density, high currents and low resistances available for pull-in; minimum flux density, low currents, and desirable resistances for holding, or after pull-in. The device accomplishes an efficient use of space, weight, wire and energy because both windings perform a useful function at all times.

DESCRIPTION OF THE DRAWINGS

The foregoing and other characteristics, objects, features and advantages of the present invention will become more apparent upon consideration of the following detailed description, having reference to the accompanying figures of the drawings, wherein.

DESCRIPTION OF A PREFERRED EMBODIMENT

Figure 1:
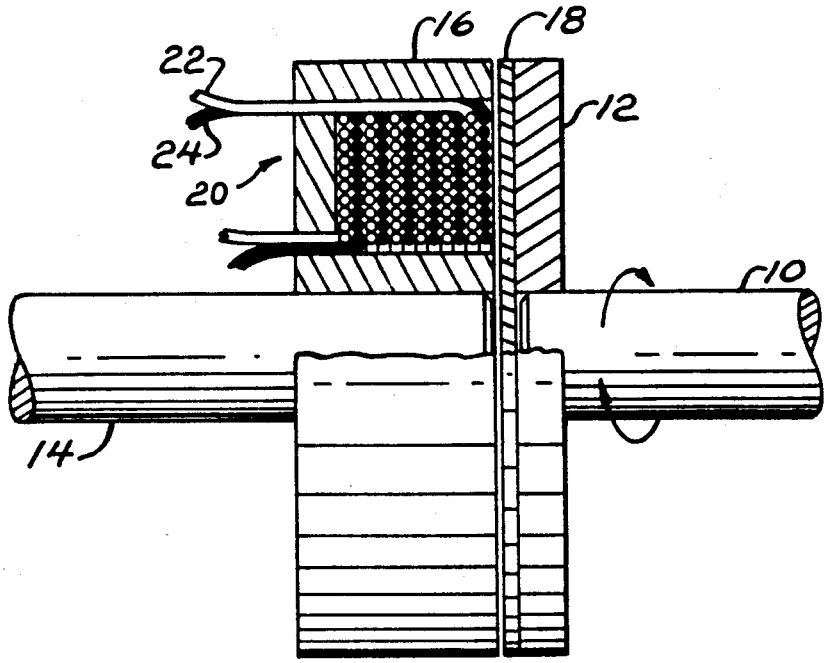
FIG. 1 is a side elevational sectioned view of a coil of an electromagnetic clutch in accordance with the invention.

After considering disclosures and teachings of the aforementioned and other references representing the state of the art, there will now be described a preferred embodiment of the present invention. It will be apparent that the unique arrangement hereinafter disclosed may be utilized in any electromagnetic device wherein the number of ampere-turn windings required to place the device in an initially energized condition is greater than the number of ampere-turn windings to maintain the device in an energized or run mode Referring to the drawings and in particular to FIG. 1, there is shown a section of an electromagnetically operated clutch and associated components wherein a driven rotatable shaft 10 is coupled rigidly to a clutch plate 12 for angular movement therewith. A rotatable drive shaft 14 is connected rigidly to a clutch housing 16 for imparting angular movement thereto. Frictional engagement or interface between the clutch housing 16 and the clutch plate 12 is accomplished by a clutch disc 18 having a relatively high or large coefficient of friction in a manner typical of these known types of clutches. Thus, the drive shaft 14 is effective to cause the driven shaft 10 to rotate when the clutch housing 16 engages the clutch plate 12 by means of the clutch disc 18.

The clutch plate 12 rotates with the driven shaft 10 but also is free to slide axially along the driven shaft 10 to engage the clutch disc 18. The clutch housing 16 rotates with the drive shaft 14 and contains therein an electromagnetic coil, indicated generally by the reference numeral 20. The coil comprises two separate windings 22 and 24 providing resistance $R_1$ and $R_2$, that differ from each other by the number of turn windings used respectively therein. The windings 22 and 24 are wound such that their magnetic field reinforce each other when both are energized wlth a desired or preselected voltage and polarity. When the coil 20 is energized, clutch housing 16 becomes an electromagnetic with an effective field of force that attracts the clutch plate 12, causing it to move toward the clutch housing 16 with sufficient force so as to couple the two shafts together through clutch disc 18 causing them to rotate as one.

Figure 2:
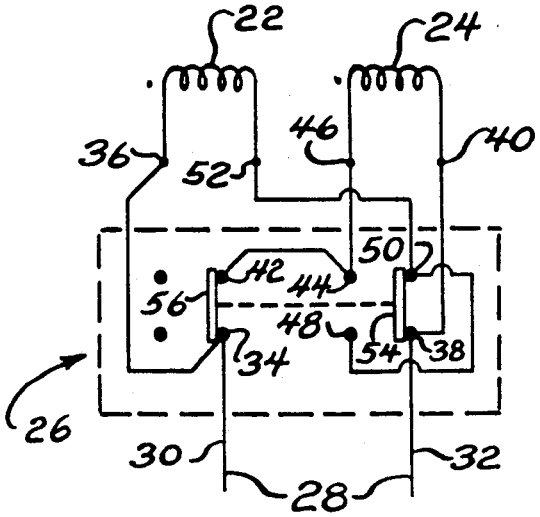
FIG. 2 is a schematic wiring diagram depicting the manner which the coil windings are interconnected for one phase of operation.
Figure 3:
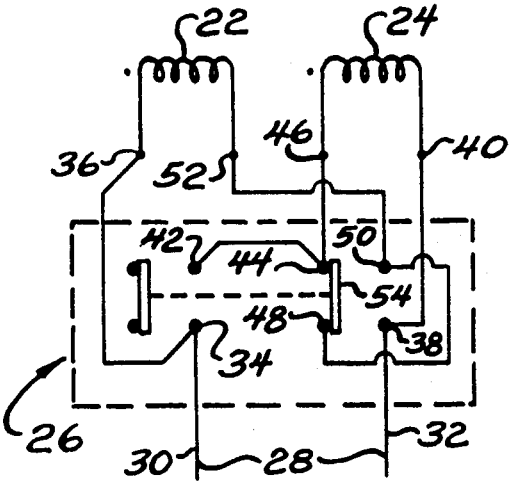
FIG. 3 is a schematic wiring diagram depicting the manner which the coil windings are interconnected for an alternate phase of operation.

Now referring to FIG. 2 and FIG. 3, there are depicted two schematic diagrams showing a preferred winding or direction of polarity and how the windings 22 and 24 of the coil 20 are interconnected during operation.

In each of FIGS. 2 and 3, there is shown a switching means 26 effective to receive electrical current from a DC power source 28 and direct the current to energize the coil windings 22 and 24 of the coil 20. The power source 28 is connected to input terminals 30 and 32 of the switching device 26. The device 26 further includes a plurality of internal contacts and terminals or other suitable means for conducting energy to the coil 20. The switching arrangement, for purposes of simplicity, is shown by reference to known relay contacts, but it should be understood that any switching device could be used, such as solid state components, or the like. Actuation of the switching device can be caused by any suitable means including mechanical motion, timed relays, manual switches, or the like. It will be understood that actuation of switching device 26 will take place quickly or at instantaneous fast response in any desired or preselected minimum interval of time after pull-in has occurred. An example of suitable electronic means for avoiding or minimizing contact sparking and wear of switching means 26 may be found in Assignee's copending U.S. application Ser. No. 514,699, filed July 18, 1983 entitled Operating Coil Control System.

Referring to FIG. 2 there is shown a desired switching arrangement during pull-in and it operates in a manner as hereinafter described. The DC power source 28, typically any desired voltage, is applied to input terminals 30 and 32 of the switching device 26. The terminal 30 is connected to a contact 34 and also to a terminal 36 located at a first or start side of the coil winding 22.

Similarly, the input terminal 32 is connected to a stationary contact 38 and also to a terminal 40 located on a first or end side of the coil winding 24. Contacts 42 and 44 are interconnected and.the contact 44 is in turn coupled to a terminal 46 located at the second or start side of the coil winding 24. A contact 48 iS interconnected to a stationary contact 50 and contact 50 is in turn coupled to a terminal 52 located at the second or end side of the coil winding 22.

As shown in FIG. 2, the flow of current from the input terminal 30 is conducted through contacts 34 and 36 to the start side of coil 22 and returns through the contact 52 to the stationary contact 50, across a normally closed movable contact 54 to the stationary contact 38 connected to the terminal 32 of the power source 28. Current also flows from the stationary contact 34 across a normally closed movable contact 56 to the stationary contact 42, then to the contact 44 and to the terminal 46 at the start side of the coil 24 and returns to terminal 32 rhrough contacts 40 and 38. It will be readily noted that the circuity shown in FIG. 2 depicts coil windings 22 and 24 connected in parallel.

Now referring to FIG. 3, current from terminal 30 to the terminal 36 of the coil 22 continues to flow through contact 34. However, actuation of switching means 26 has taken place and the movable contact 56 has been moved to an open position, so that no flow of current occurs between the contacts 34 and 42. Current flow from the end side of coil 22 returns through the contacts 52, 50, 48, across the movable contact 54 that now has been moved to a closed position to connect with the contact 44, permitting further current flow to the contact 46 at the start side of the coil 24. Current is returned from the end side of coil 24 through contacts 40 and 38 to the input terminal 32. It will now be readily noted that the circuity of FIG. 3 depicts the windings 22 and 24 connected in series. It will be understood that both FIGS. 2 and 3 show polarity or direction of current flow beginning at the designated or start side of each of coils 22 and 24. Polarity or current flow could occur in an opposite direction so long as the orientation of start and end sides of coils 22 and 24 are maintained as shown herein.

Thus, each coil 22 and 24 is energized continuously both during and after pull-in. In each mode, the turns of the coils 22 and 24 are added or summed together to obtain the total number of effective windings of the coil. A substantial additional advantage is realized when the ampere-turns (NI) are calculated.

In the parallel configuration of FIG. 2 used during pull-in, the current is determined by the equivalent parallel resistance of $R_1$ and $R_2$. This is calculated using the product over the sum formula for parallel resistance or $R=(R_1R_2/R_1+R_2)$.

In the series connection of FIG. 3 used after pull-in, the current obtained is calculated using the sum of the resistances, designated respectively, $R_1$ and $R_2$ of coils 22 and 24.

The resulting resistance in parallel configuration is less than either $R_1$ or $R_2$ alone and depending on the values, the ampere-turns obtained are substantially higher for pull-in than for holding. As a minimum example, if $R_1$ and $R_2$ are equal, the resulting ratio between pull-in and hold or run mode currents is 4 to 1.

The preferred embodiment disclosed herein is depicted as a combination of two coils. It will be understood that it is possible within the scope of the present invention to separately connect combinations of multiple coils first in parallel and subsequently in series to achieve fast response in changing from a start to a run mode operation. It is also possible to utilize an AC power source to achieve the objects of the present invention.

In order to better understand the improved electronic switching means of the present invention, reference is made to FIGS. 2 and 3. In FIGS. 2 and 3 the switching means 26, is shown as a double pole-double throw (DPDT) device illustrative of well known, contact-type electromechanical devices readily available for switches, relays and the like.

Figure 4:
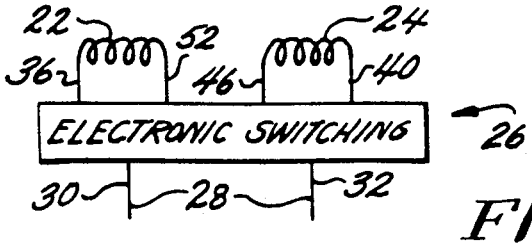
FIG. 4 is a schematic wiring arrangement depicting the manner in which electronic switching means is utilized for operation of the invention.
Figure 5:
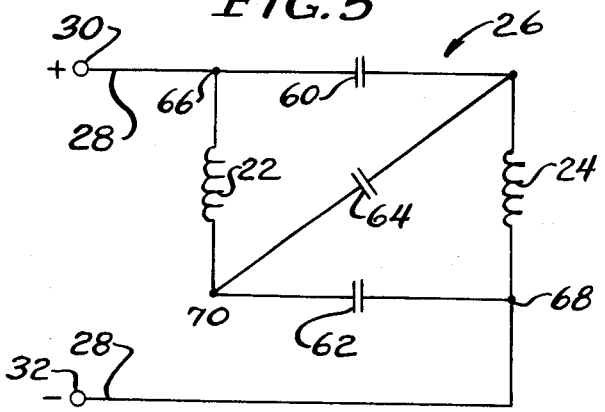
FIG. 5 is a schematic wiring diagram depicting the manner in which parallel current is utilized for the first phase of operation and series current is utilized for the alternate phase of operation.

As is readily seen, there is one set of contacts within the switching means 26, which is not used. Thus, the desired switching action is achieved by using three separate sets of contacts, 34 and 42; 44 and 48; and 38 and 50. The concept of using three separate sets of contacts to achieve a desired switching arrangement that initially provides power to parallel current circuitry and thereafter switches to series current circuitry is shown in FIG. 5. This concept is intended to impement the electronic switching means of FIG. 4.

In FIG. 5, three separate sets of contacts are respectively designated 60, 62 and 64. It will be understood that 60 and 62 are always activated simultaneously and separately from 64. In other words, when contacts 60 and 62 are on, contact 64 is off. Conversely, when contact 64 is on, contacts 60 and 62 are off.

Figure 6:
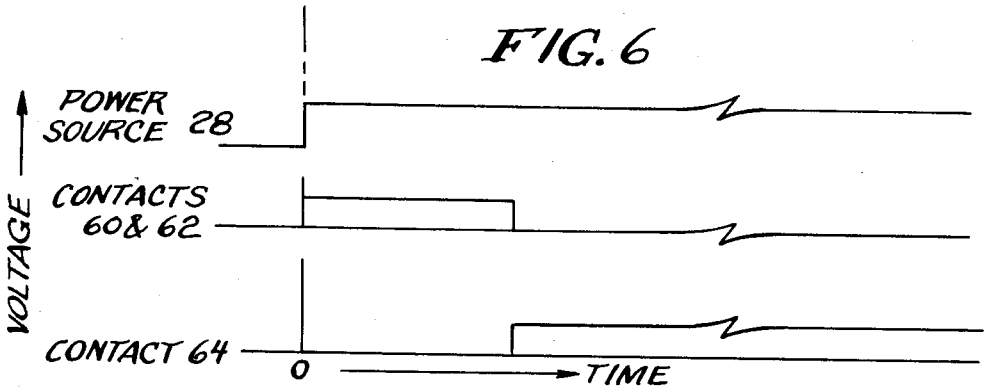
FIG. 6 is a graphic representation of voltage plotted against time depicting the manner in which initial application of power effects the operation of parallel current for a preselected period of time and when switched off, series current is switched on for an undetermined period of run mode operation.

Referring to FIG. 6, it can be seen that when the power source 28 is first applied to the input terminals 30 and 32, contacts 60 and 62 are operated first, for a fixed, predetermined time period and when switched off, contact 64 is placed in operation. Contact 64 remains activated until the power source is disconnected.

When power is applied to the circuit of FIG. 5, current will flow from the terminal 30 to a terminal 66 between closed contact 60 and winding 22, whereby the current divides into two components with magnitudes inversely proportional to the resistance of the windings 22 and 24. The first divided component of current flows through winding 22, closed contact 62, a terminal 68 and back to the input terminal 32.

The second current component flows through closed contact 60, continues through winding 24, terminal 68 and back to input terminal 32 and the power source 28. No current flows through contact 64 because it is open at this time.

In this mode the two windings 22 and 24 are said to be connected in parallel and the total motor winding current is the sum of the two components as hereinbefore described, providing the high magnetic force required to begin operation of a magnetic control device After a fixed, predetermined time when the motor has reached running speed, the contacts 60 and 62 are switched to an open position and contact 64 is placed in a closed position. When this occurs, no parallel current paths will flow from the termina 66 to contact 60 or from a terminal 70 through contact 62 to terminal 68. Thus, the total current must flow from terminal 66 through winding 22, the now closed contact 64, winding 24, terminal 68 and finally back to terminal 32 and the power source 28. The two windings 22 and 24 are now said to be in series and the motor current is reduced to a lower running value as hereinabove described.

Figure 7:
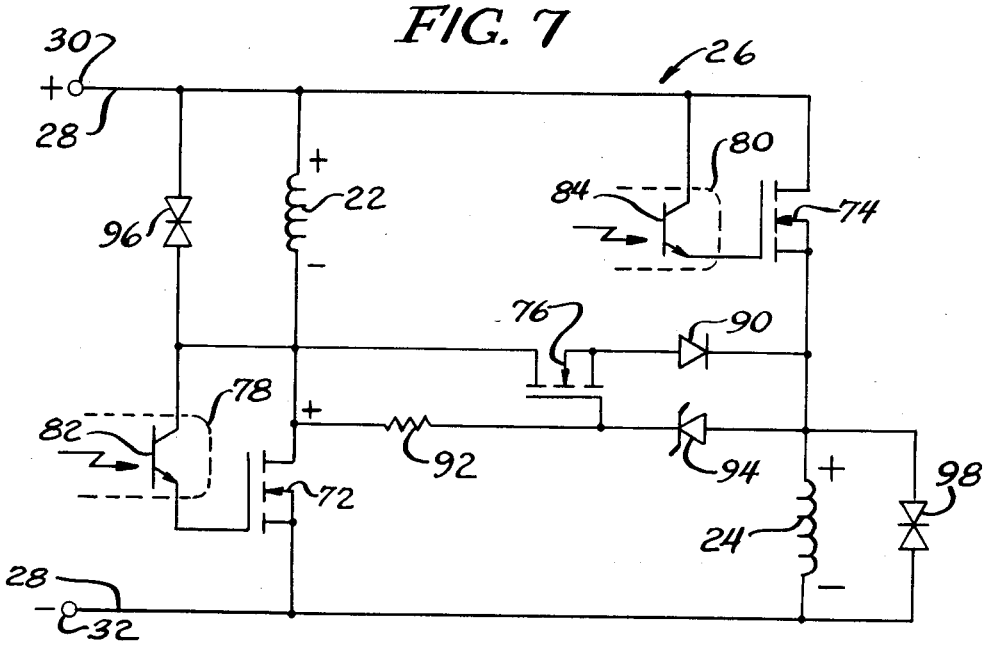
FIG. 7 is a schematic wiring diagram that shows solid state Mosfet switching devices and associated structural elements in accordance with the invention.

Now referring to FIG 7, there is shown an embodiment of electronic switching means adaptable for use in the present invention. The contact means or switches 60, 62 and 64 are implemented as a trio of MOSFET switching devices 72, 74 and 76 which are essentially DC operated devices, as the present invention relates primarily to DC powered motors. It should be understood that AC motors also may be operated within the concept of the present invention by changing the MOSFET devices to AC operated switching devices such as TRIACs, with TRIAC type opto couplers replacing the transistor type opto couplers associated with MOSFETS and with control circuitry similar to that described herein.

Referring now to the switching means 26 of FIG. 7, the on/off status of each MOSFET 72 and 74 is determined by the magnitude and polarity of the voltage present at its respective gate lead, which in turn is controlled respectively by the conduction of a pair of opto couplers 78 and 80. The opt couplers 78 and 80 have output transistor portions 82 and 84 adaptable to transmit power to each MOSFET 72 and 74. The output transistor portions 82 and 84 receive energy from input LED portions 86, 88 (FIG. 8) of the opto couplers 78 and 80.

When light impinges upon the photo sensitive base of the opto coupler transistor 82, it turns on and positive voltage at the collector is passed through to the emitter and to the gate of the MOSFET 72 which causes it to become operational in an on condition and thereby provide a high current path through winding 22, MOSFET 72 and back to terminal 32 and the power source 28

Similarly, simultaneous operation occurs with output transistor 84 causing current flow through MOSFET 74, winding 24 and back to terminal 32 and the source 28. Thus the windings 22 and 24 are connected in parallel at this time and a desired large magnetic force is available to activate an electromagnetic device.

It is noted that MOSFET 76 is held in the off position at this time by means of the reverse polarization condition of MOSFETs 72 and 74 being in the on position. A diode 90 protects MOSFET 76 from the reverse positive voltage developed by the high current flow through windings 24.

When MOSFETs 72 and 74 are turned off by turning off opto couplers 78 and 80, the high positive voltage across MOSFET 72 causes a current flow through a resistor 92 and a zener diode 94 which maintains the gate voltage of MOSFET 76 above its switching threshold, thus causing it to become operational in an on condition. Windings 22 and 24 are now connected in series to establish a reduced power run mode operation.

A pair of transient suppressors 96 and 98, which can be thyrectors, varistors or the like are connected across windings 22 and 24 to limit the switching transients so as to ensure a safe level of operation for the circuit components.

Figure 8:
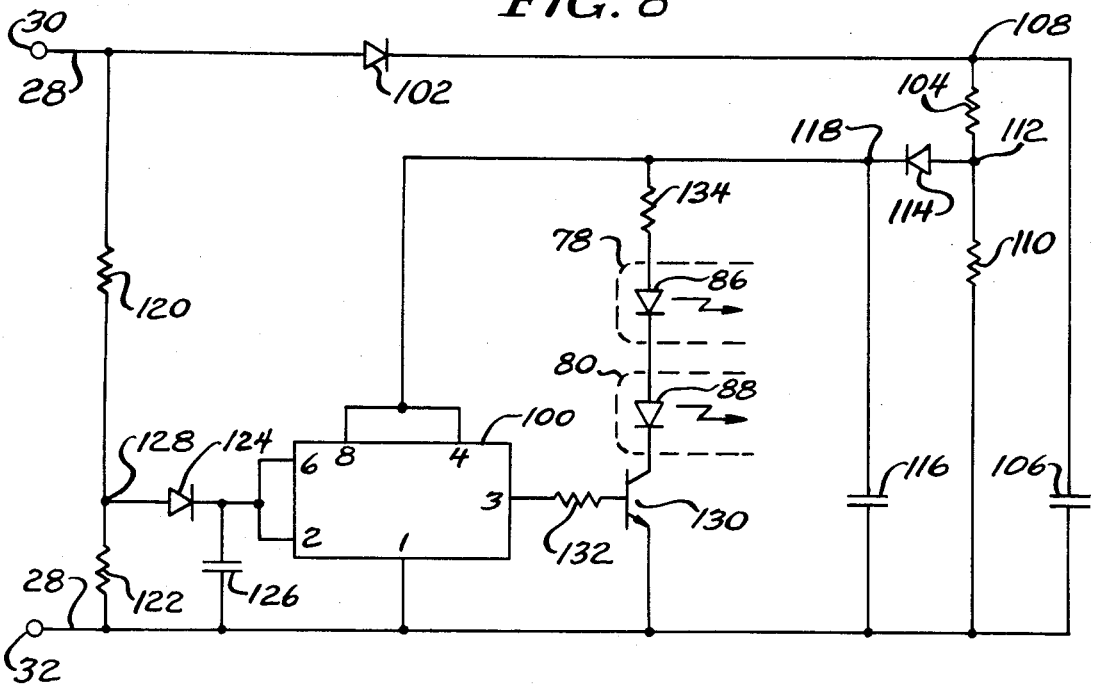
FIG. 8 is a schematic wiring diagram depicting the manner in which control circuitry is utilized to operate solid state switching means in accordance with the timed relationship shown in FIG. 6.

The on/off status of the opto couplers 78, 80 and the MOSFETs 72, 74 and 76 is determined by the control circuit of FIG. 8 in accord with the graphic representation of the timing diagram of FIG. 6.

Figure 10:
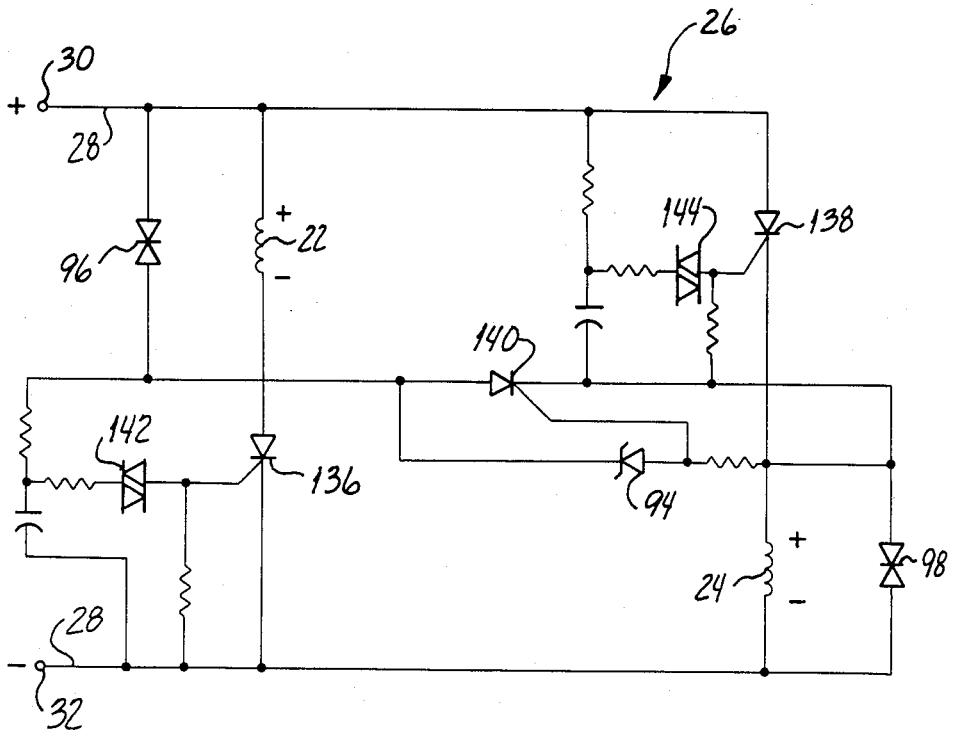
FIG. 10 is a schematic wiring diagram that shows solid state SCR switching devices and associated structural elements in accordance with the invention.

Now referring to FIG. 10, there is shown an additional embodiment of electronic switching means adaptable for use in the present invention. The contact means or switches 60, 62 and 64 are implemented as a trio of Thyrister or SCR swithcing devices 136, 138, and 140 which are essentially AC operated devices, enabling the present invention to be utilized for the operation of AC powered motors.

Referring now to the switching means 26 of FIG. 10, the on/off status of each SCR 136 and 138 is determined by the magnitude and polarity of the voltage present at its respective gate lead, which in turn is controlled respectively by the conduction of a pair of opto triacs 142 and 144 which are adaptable to transmit power to each SCR 136 and 138.

In a manner similar to that described hereinabove, when SCRs 136 and 138 are in an on position energized by opto triacs 142 and 144, coils 22 and 24 will be connected in parallel for making available a large magnetic force to activate an electromagnetic device. Reverse polarization occurs at this time and is effective to maintain SCR 140 in an off position. When opto triacs 142 and 144 are turned off, SCRs 136 and 138 become inactive, making it possible for SCR 140 to be in a position and connect windings 22 and 24 in series so as to establish a reduced power run mode operation.

The on/off status of the opto triacs 142, 144 and the SCRs 136, 138 and 140 is determined by the control circuit of FIG. 8 in accord with the graphic representation of the timing diagram of FIG. 6.

Referring now to the control circuitry of FIG. 8, an industry standard integrated circuit general purpose timer 100, known as an ICM7555, manufactured by the INTERSIL Corporation, is provided with an operating voltage supply when an AC (or DC) power source such as 28 is applied to terminals 30 and 32. A diode 102 rectified the power source 28 so that only positive half wave voltages are applied to the junction of a resistor 104 and capacitor 106. The capacitor 106 filters the half wave pulses to an acceptably smooth and stable DC voltage at point 108. A second resistor 110, in series with resistor 104, divides the voltage at point 112 down to a magnitude within the safe operating range of the timer IC 100.

The positive voltage at point 112 passes through a diode 114, the function of which will be hereinafter described, and is further filtered by a capacitor 116 at point 118 . Capacitors 106 and 116 function as energy storage devices to provide for surges of power required by the control circuitry. Diode 114 prevents this stored energy in the capacitor 116, from discharging back into the divider network when the voltage at the point 112 drops below the voltage at point 118.

Thus, the control circuit is provided with a stable source of voltage and sufficient stored reserve power to accomodate the varying demands of the circuit.

The operation of the integrated circuit timer 100 is well known to those in the industry but is reviewed briefly herein as it relates to this invention.

Operating voltage for the timer 100 is applied to terminal 8 with respect to common at terminal 1. Terminal 4 provides a reset function which is not a part of the present invention, so it is connected to a stable logical high voltage, i.e. the supply voltage.

The timer output is taken from terminal 3, which switches from a low voltage near to common, to a high voltage almost equal to the supply voltage at terminal 8 in response to input signals at terminals 2 and 6.

When a power source is first applied at 28, the supply voltage at point 118 rises rapidly to a level required to cause the timer IC 100 to begin operation.

The power source 28 is again divided down to a level safe for the timer 100 by the action of a pair of resistors 120 and 122.

A diode 124 allows only the positive portions of the source 28 to pass on to capacitor 126 at the junction of input terminals 2 and 6 of the timer 100. The diode 124 also prevents the charge on capacitor 126 from discharging during negative alternations of the power source 28.

Figure 9:
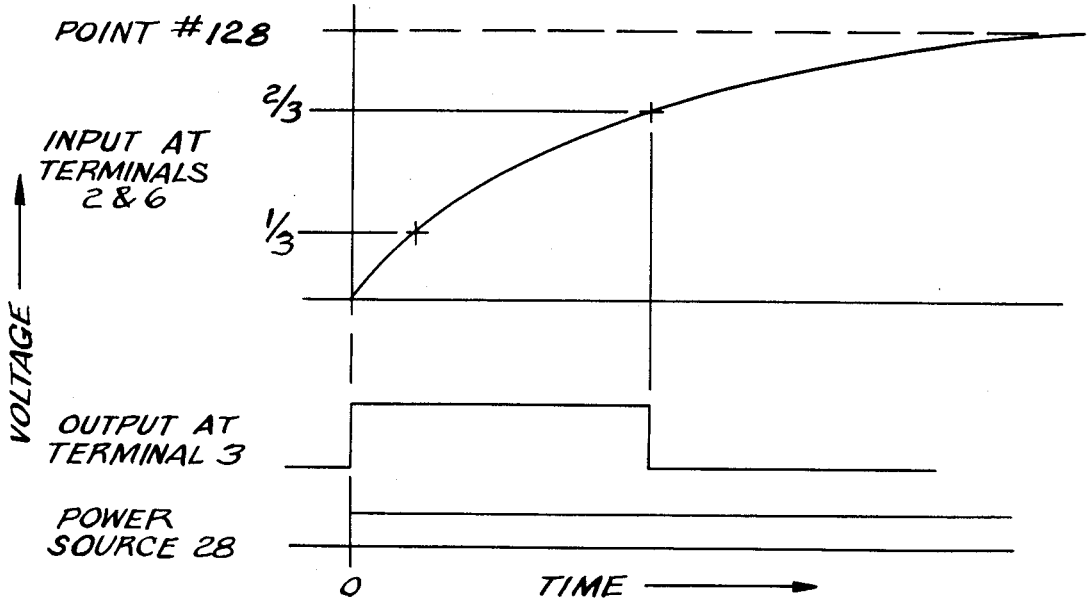
FIG. 9 is a graphic representation of voltage plotted against time depicting the manner in which initial application of power causes parallel current to be operative until a preselected percent of supply voltage is reached at which time series current is switched in to establish a run mode operation

The charge on capacitor 126 rises slowly toward the voltage at point 128 in an exponential manner as illustrated in the wave form of FIG. 9

It is a characteristic of the timer IC 100 that if the voltage at input terminal 2 falls even momentarily, below a trigger level defined as approximately $\frac{1}{3}$ of the supply voltage at termina 8, the output at terminal 3 will be switched to a positive voltage near the supply voltage at point 118 and remain there until the input voltage at terminal 6 reaches a threshold voltage defined as approximately $\frac{2}{3}$ of the supply voltage at terminal 8, at which time it will return to a voltage near zero. This relationship is shown in the waveform of FIG. 9.

Thus, when the power source 28 is first applied, the timer 100 output voltage at terminal 3 is highly positive for a time determined by the RC time constant of resistors 120 and 122 and capacitor 126, after which time the output voltage at terminal 3 is returned to near zero volts.

The positive output voltage at terminal 3 is applied to the base of an NPN type transistor 130 through a current limiting resistor 132

The base current through the transistor 130 causes a current flow in the collector which is multiplied by gain factor BETA. This current flows through the pair of opto coupler LEDs 86 and 88 and is limited by a series resistor 134.

The light caused by current flow through the opto coupler LEDs 86 and 88 is coupled to the photo sensitive bases of the output transistors 82 and 84 of FIG. 7 turning them on and ultimately turning on MOSFETs 72 and 74 as hereinbefor described.

While the invention has been described with reference to a preferred embodiment, it will be understood by those skilled in the art that various changes may be made and equivalents may be substituted for elements thereof wirhout departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. Electronic switching means for controlling the operation of an electromagnetic apparatus having first and second coil winding means, said switching means at times connecting said first and said second coil winding means in parallel and at other times in series, whereby said first and said second coil winding means are initially energized at a maximum ampere turns start mode when connected in parallel and said first and said second coil winding means are thereafter energized to a minimum ampere turns run mode when connected in series comprising a power source providing energy to said first and said second coil winding means, first contact means disposed between said first and said second coil winding means at first sides thereof, second contact means disposed between said first and said second coil winding means at second sides thereof, third contact means disposed between said first and said second coil winding means interconnecting a first side of one of said coil winding means with a second side of the other of said coil winding means, whereby when said first and said second contact means are activated to an on position, said third contact means remains in an off position and said first and said second coil winding means are connected in parallel for initial start mode operation, and whereby when said first and said second contact means are switched to an off position, said third contact means is activated to an on position and said first and said second coil winding means are connected in series for run mode operation.

2. Switching means as claimed in claim 1 wherein each of said contact means is opened and closed by DC operated solid state switching means.

3. Switching means as claimed in claim 1 wherein each of said contact means is opened and closed by AC operated solid state switching means.

4. Switching means as claimed in claim 2 wherein said DC operated solid state switching means are Mosfets.

5. Switching means as claimed in claim 3 wherein said AC operated solid state switching means are TRIACS.

6. Switching means as claimed in claim 2 comprising opto-coupler means for transmitting power to a first and a second solid state switching means and for simultaneously withhoplding power from a third solid state switching means.

7. Swithcing means as claimed in claim 6 comprising timing means for controlling said opto-coupler means between on and off positions.

8. Swithcing means as claimed in claim 7 wherein said input voltage to said timing means reaches a threshold value and thereafter drops to substantially zero turning off said opto-coupler means permitting power to flow to said third solid state switching means.

9. Electronic switching means for controlling the operation of an electromagnetic apparatus having first and second coil winding means, said switching means at times connecting said first and said second coil winding means in parallel and at other times in series, whereby said first and said second coil winding means are initially energized at a maximum ampere turns start mode when connected in parallel and said first and said second coil winding means are thereafter energized to a minimum ampere turns run mode when connected in series, comprising a power source providing energy to said first and said second coil winding means, first solid state switching means between said first and said second coil winding means at first sides thereof, second solid state switching means disposed between said first and said second coil winding means at second sides thereof, third solid state switching means disposed between said first and said second coil winding means interconnecting a second side of said first coil winding means with a first side of said second coil winding means, whereby when said first and said second solid state switching means are activated to an on position, said third solid state switching means remains in an off position and said first and said second coil winding means are connected in parallel for initial start mode operation, and whereby when said first and said second solid state switching means are switched to an off position, said third solid state switching means is activated to an on position and said first and said second coil winding means are connected in series for run mode operation.

10. Switching means as claimed in claim 9 wherein each of said solid state switching means comprises a DC operated device.

11. Switching means as claimed in claim 9 wherein each of said solid state switching means comprises an AC operated device.

12. Switching means as claimed in claim 10 wherein DC operated devices are Mosfets.

13. Switching means as claimed in claim 11 wherein said AC operated devices are TRIACS.

14. Switching means as claimed in claim 9 comprising opto-coupler means for transmitting power to said first and said second solid state switching means and for simultaneously withholding power from said third solid state switching means.

15. Switching means as claimed in claim 14 comprising timing means for controlling input voltage to said opto-coupler means.

16. Switching means as claimed in claim 15 wherein said input voltage to said timing means reaches a threshold value and thereafter drops to substantially zero turning off said opto-coupler means permitting power to flow to said third solid state switching means.

17. Switching means as claimed in claim 9 wherein said first and said second solid state switching means when in an on position provide a natural bias to prevent said third solid state switching means from being in an on position, and said first and said second solid state switching means when in an off position causing a forward bias to place said third solid state switching means in an on position.

* * * * *